US007107772B2

(12) United States Patent
Chen et al.

(10) Patent No.: US 7,107,772 B2
(45) Date of Patent: Sep. 19, 2006

(54) MULTI-POINT STAGING STRATEGY FOR LOW EMISSION AND STABLE COMBUSTION

(75) Inventors: Alexander G. Chen, Ellington, CT (US); Donald W. Kendrick, Bellevue, WA (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/048,419

(22) Filed: Jan. 31, 2005

(65) Prior Publication Data

US 2005/0126180 A1 Jun. 16, 2005

Related U.S. Application Data

(63) Continuation of application No. 10/260,311, filed on Sep. 27, 2002, now Pat. No. 6,962,055.

(51) Int. Cl.
*F23R 3/42* (2006.01)

(52) U.S. Cl. ..... 60/737; 60/746

(58) Field of Classification Search ..... 60/734, 60/737–739, 746, 747, 773
See application file for complete search history.

(56) References Cited

U.S. PATENT DOCUMENTS

| | | | | |
|---|---|---|---|---|
| 4,356,698 | A * | 11/1982 | Chamberlain | 60/746 |
| 4,967,561 | A * | 11/1990 | Bruhwiler et al. | 60/737 |
| 5,303,542 | A * | 4/1994 | Hoffa | 60/746 |
| 5,339,635 | A * | 8/1994 | Iwai et al. | 60/746 |
| 5,713,206 | A * | 2/1998 | McWhirter et al. | 60/747 |
| 6,092,363 | A * | 7/2000 | Ryan | 60/739 |
| 6,360,525 | B1 * | 3/2002 | Senior et al. | 60/747 |

* cited by examiner

*Primary Examiner*—Michael Koczo, Jr.
(74) *Attorney, Agent, or Firm*—Bachman & LaPointe

(57) ABSTRACT

The present invention relates to an improved multi-point injector for use in a gas turbine engine or other types of combustors. The multi-point fuel injector has a plurality of nozzles arranged in at least two arrays such as concentric rings. The injector further has different fuel circuits for independently controlling the fuel flow rate for the nozzles in each of the arrays. Each of the nozzles include a fluid channel and one or more swirler vanes in the fluid channel for creating a swirling flow within the fluid channel. A method for injecting a fuel/air mixture into a combustor stage of a gas turbine engine is also described. At least one zone has a flame hot enough to stabilize the entire combustor flame.

8 Claims, 4 Drawing Sheets

MULTI-POINT STAGING STRATEGY FOR LOW EMISSION AND STABLE COMBUSTION

CROSS-REFERENCED TO RELATED APPLICATION(S)

This application is a continuation application of U.S. patent application Ser. No. 10/260,311, filed Sep. 27, 2002 now U.S. Pat. No. 6,962,055, entitled MULTI-POINT STAGING STRATEGY FOR LOW EMISSIONG AND STABLE COMBUSTION, by Alexander G. Chen et al.

BACKGROUND OF THE INVENTION

The present invention relates to a multi-point fuel injector for use in a combustor of a gas turbine engine or other types of combustors.

One of the biggest challenges for gas turbines, especially for industrial applications, is to have good emission performance and combustion stability for a wide range of power settings and ambient condition. If one has an industrial gas turbine with low emissions of NOx, CO and UHC at 100% power, as one reduces the power, which is usually done by reducing the amount of fuel to the engine, the fuel/air mixture in the combustor typically gets leaner. The leaner mixture of fuel/air lowers the flame temperature and creates a flame which can be quenched relatively easily by a cooler combustor wall or cooling film on the combustor wall. The quenching effect creates excessive CO and UHC and high dynamic pressure. If they are not further oxidized, the CO and UHC become pollutants. The other issue associated with too lean fuel/air mixture is that it creates unstable combustion. Conversely, if one has a gas turbine with low NOx, CO, UHC and acoustics at part power condition, as one increases the power, which is usually done by increasing the amount of fuel to the engine, the fuel/air mixture in the combustor typically gets richer. The richer mixture of fuel/air raises the flame temperature and creates a flame which can generate more NOx. Similar situations can happen with different ambient temperatures. If one has a gas turbine with low NOx, CO, UHC and acoustics at high ambient temperature, as ambient temperature becomes lower, the flame temperature decreases which may create high CO, UHC and unstable flame. Or if one has a gas turbine with low NOx, CO, UHC and acoustics at low ambient temperature, as ambient temperature becomes higher, the flame temperature increases which may create excessive NOx.

SUMMARY OF THE INVENTION

Accordingly, it is an object of the present invention to provide a multi-point fuel injector which addresses emission and stability problems.

It is a further object of the present invention to provide an improved method for injecting a fuel/air mixture into a combustor of a turbine engine or other applications which avoids creating excessive CO and UHC at wide power levels and ambient conditions.

The foregoing objects are attained by the present invention.

In accordance with the present invention, a novel multi-point injector is provided. The multi-point injector broadly comprises a plurality of nozzles arranged in at least two arrays and means for independently controlling a fuel flow to each array of nozzles. Each of the nozzles in each array includes an outer body defining a fluid channel and vane means for creating a swirling flow within the fluid channel.

Further, in accordance with the present invention, a method for injecting a fuel/air mixture into a combustor of a gas turbine engine is provided. The method broadly comprises the steps of providing an injector having nozzles arranged in at least two arrays, injecting a fuel/air mixture into the combustor stage by supplying fuel in a first quantity to each nozzle in an outermost one of the arrays and supplying fuel in a second quantity to each nozzle in a second one of the arrays; and maintaining the outermost one of the arrays at a flame temperature high enough to maintain a stable and less polluting flame.

Other details of the multi-point staging strategy for low emissions and stable combustion of the present invention, as well as other objects and advantages attendant thereto are set forth in the following detailed description and the accompanying drawings wherein like reference numerals depict like elements.

DETAILED DESCRIPTION OF THE PREFERRED EMBODIMENT(S)

Figure 1:
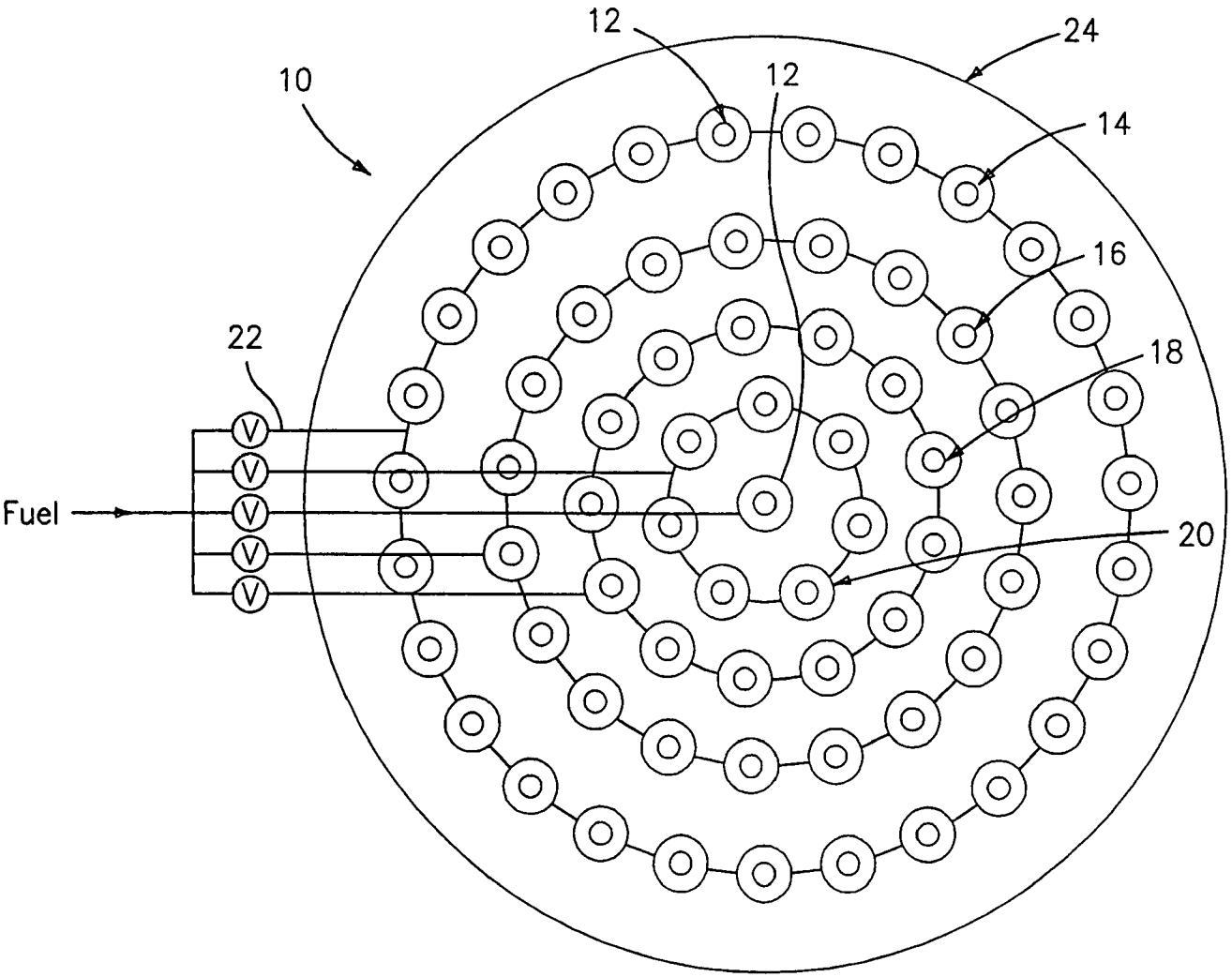
FIG. 1 illustrates a first embodiment of a multi-point injector in accordance with the present invention.

Referring now to the drawings, FIG. 1 illustrates a first embodiment of a multi-point injector 10 in accordance with the present invention. The multi-point injector 10 has nozzles 12 for injecting a fuel-air mixture into a combustor stage of a gas turbine engine. The nozzles 12 are arranged in a plurality of arrays. In the embodiment of FIG. 1, the nozzles 12 are arranged in four concentric rings 14, 16, 18, and 20 with an optional nozzle in the center. While the nozzle arrays have been shown to be concentric rings, it should be recognized that the nozzles 12 can be arranged in different configurations, including but not limited to squares, rectangles, hexagons, or parallel lines.

In accordance with the present invention, means for independently controlling the fuel flow rate for each of the rings 14, 16, 18, and 20 and the optional center nozzle are provided. The fuel flow rate controlling means comprises a different fuel circuit 22 for each ring 14, 16, 18, and 20 and the optional center nozzle. Each fuel circuit 22 may each comprise any suitable valve and conduit arrangement known in the art for allowing control over the flow rate of the fuel provided to each one of the rings 14, 16, 18 and 20 and to the optional center nozzle.

When power reduction is required or ambient temperature is reduced, instead of reducing fuel to all nozzles 12 to the same extent, the flow of fuel is reduced differently for each ring 14, 16, 18 and 20 and the optional center nozzle. The outermost ring 14 may be kept at a flame temperature that is high enough to keep the flame stable so that CO and UHC created from the combustor and dynamic pressure is low, but not so high that ring 14 creates excessive NOx. The other rings 16, 18, and 20 and the optional center nozzle are preferably fueled at lower fuel/air ratios. As a result, lower flame temperature occurs at these rings to achieve more power reduction or to accommodate lower ambient temperature. If desired, some or all of the other rings can be fueled at higher fuel/air ratios if better flame stability is wanted and if NOx limit and power setting/ambient temperature allow. Since nozzle rings 16, 18, and 20 do not interact with the cooler wall or cooling film on the combustor wall 24, the flame from the nozzles 12 in those rings will be less quenched, thus avoiding the creating of excessive CO and UHC. In this way, the CO and UHC emissions can be reduced at lower power settings of the engine or at lower ambient temperature. Since the nozzles 12 in ring 14 are kept at a high enough flame temperature as the power is reduced or ambient temperature is reduced, they can serve as flame stabilizers to stabilize the entire combustion process for all the nozzles 12 and extend lean blowout limit.

If desired, each ring 14, 16, 18, and 20 may define a zone and the injector may be provided with a means for controlling the flow of fuel to one zone as a function of the flow of fuel to a second zone.

Figure 5:
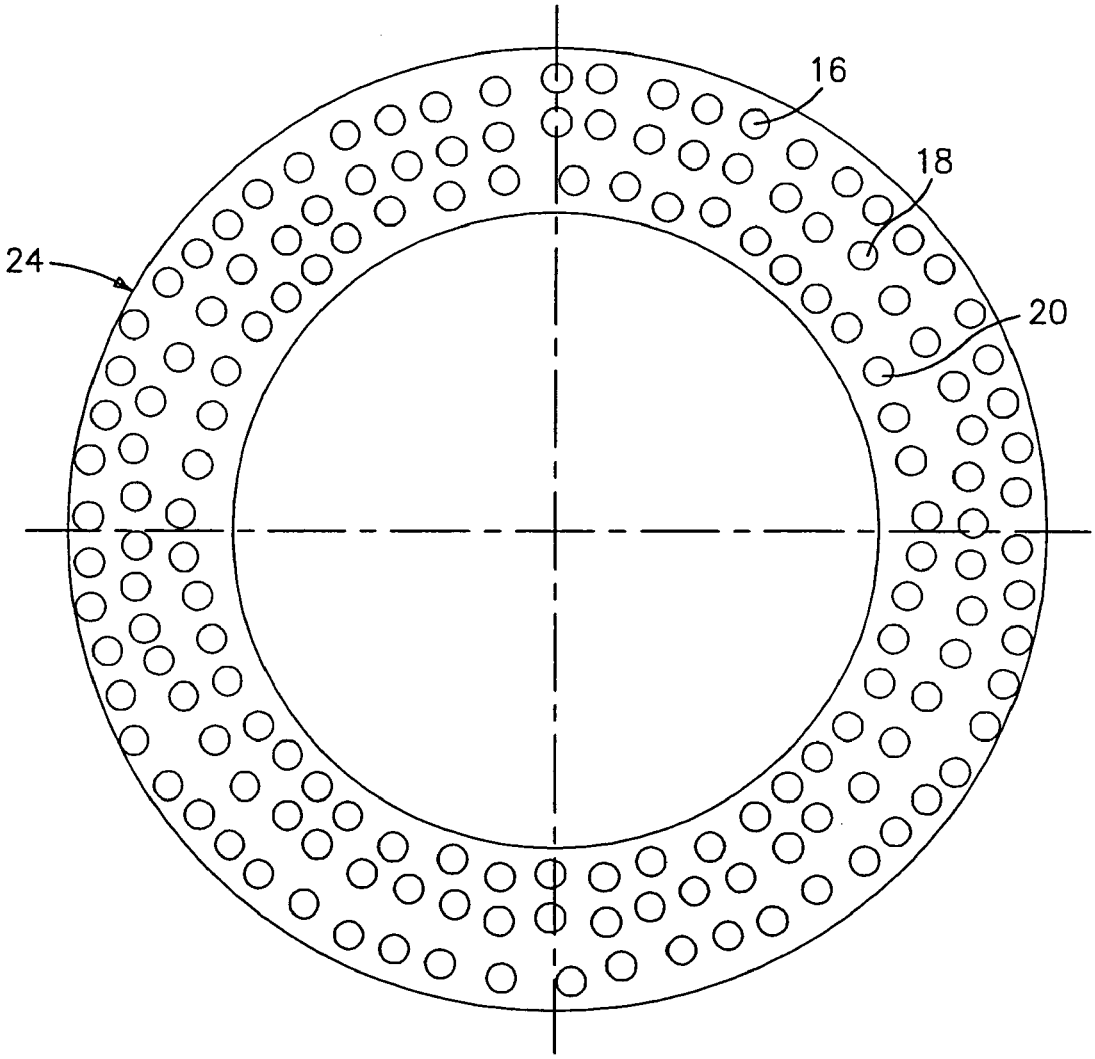
FIG. 5 illustrates an annular burner having an injector in accordance with the present invention.

The injector 10 and the method outlined above can be used in different kind of combustors (can or annular). In an annular burner as shown in FIG. 5, the flame temperatures in the zones near at least one of the combustor walls 24 is kept high enough to stabilize the flame while leaning some others to reduce power or to accommodate lower ambient temperature. Typically, the annular burner will have a plurality of nozzle rings such as nozzle rings 16, 18 and 20. The zone which is kept hot to stabilize the flame preferably is the one next to a wall. In some instances, this may be the outermost ring of nozzles. In other instances, this may be the innermost ring of nozzles. In some situations, it may be desirable to keep an outer zone hot, a middle zone cool, and an inner zone hot.

Figure 2:
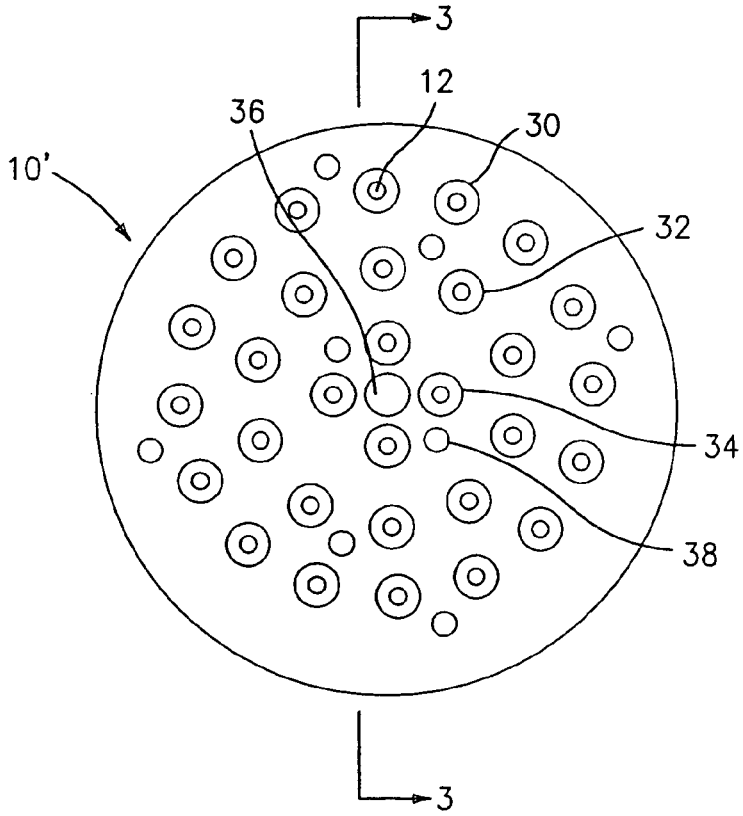
FIG. 2 illustrates a second embodiment of a multi-point injector in accordance with the present invention.
Figure 3:
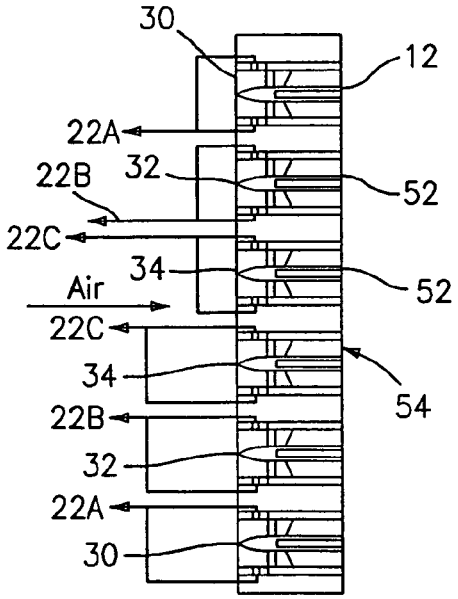
FIG. 3 is a sectional view taken along lines 3—3 in FIG. 2.

While FIG. 1 illustrates the use of four rings 14, 16, 18, and 20, the number of rings of nozzles can be arbitrary. Different rings of nozzles can be fueled differently to achieve the best emissions and stability. For example, FIGS. 2 and 3 illustrate an embodiment of an injector 10' which has three concentric rings 30, 32, and 34 of nozzles 12. The rings of nozzles 30, 32, and 34 may be fueled so that the outermost ring 30 and the innermost ring 34 are maintained hotter than the center ring 32. As before, each of the rings 30, 32, and 34 of nozzles 12 may be fueled via independent fuel circuits 22A, 22B, and 22C, respectively.

In the injector embodiments of the present invention, the centerbody portion 36 may be closed if desired or used to inject fuel or fuel/air mixture and an ignitor 38 may be positioned off center.

Figure 4:
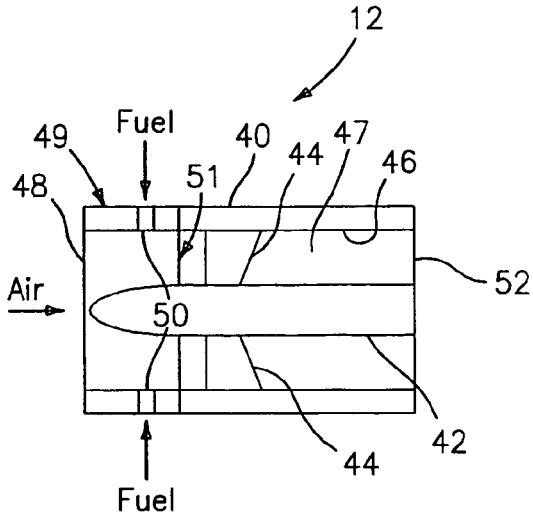
FIG. 4 is an enlarged view of a nozzle used in the multi-point injectors of the present invention.

Each nozzle 12 used in the embodiments of FIGS. 1 and 2 may have a construction such as that shown in FIG. 4. In particular, each nozzle 12 may have an outer body 40, such as a cylindrical or other shape casing, an inner body 42 which is cylindrical, conical, rectangular and the like, centered or off-centered or even non-existent and one or more swirler vanes 44 extending between the inner body 42 and an inner wall 46 of the casing 40. The swirler vanes 44 are used to create a swirling flow in the fluid channel 47 formed by the inner wall of the outer body 40 and the inner body 42. It has been found that the creation of the swirling flow in the channel 47 promotes mixing of the fuel and air which reduces NOx and flame stabilization. The swirler vanes 44 for a respective nozzle 12 may be in the same direction or in different directions.

Figure 6:
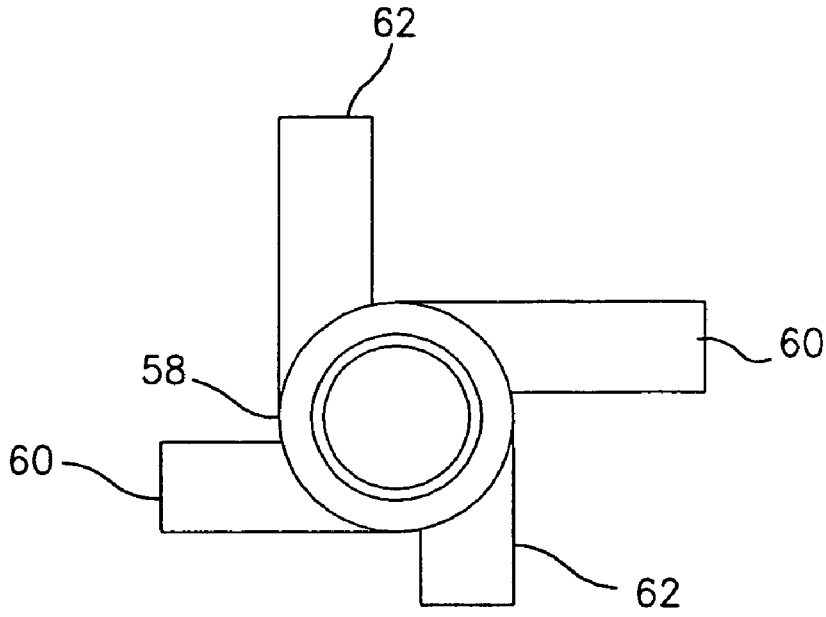
FIG. 6 illustrates a tangential entry swirl device which can be used in the injector of the present invention.

Each nozzle 12 used in the embodiments of FIGS. 1 and 2 may have other constructions such as that shown in FIG. 6. In the embodiment of FIG. 6, the fuel and air are tangentially injected from the outer wall of a swirl cup 58 via tangential inlets 60 and 62 respectively to create swirling motion. The injection direction does not have to be perpendicular to the axis of the swirl cup 58. One or more fuel inlets can be injecting fuel upstream or downstream of the air injection or injections, or in between air injections. Axial air or fuel or both can also be added.

While swirling may be used in each nozzle 12, the present invention will work without swirling and thus vanes 44 may be omitted if desired.

Further, each nozzle 12 is provided with a fuel/air mixture. If desired, a fuel injection unit 49 may be placed adjacent the inlet 51 of the nozzle 12 for premixed flame or be placed adjacent to outlet 52 for diffusion flame. The fuel injection unit 49 may have one or more fuel inlets 50 for delivering fuel to the interior of the fuel injection unit 49. The fuel injection unit can also be an object hanging in the air stream. The fuel inlet 50 can be upstream or downstream of the vanes 44, in the area of the vanes 44, in the vanes 44, from the wall of the outer body 40, or from the inner body 42. The fuel inlets 50 may be supplied with fuel from one of the fuel circuits 22A, 22B, and 22C. While the fuel injection unit 49 and nozzle 12 may be separate elements, they could also be a single integral unit. Further, a diffusion or premixed pilot can be added to the inner body 42.

It should be noted that in an axial swirler design, the swirl vane angle does not have to be the same within the swirler, within the zone, or among different zones. Further, the outlet of all the nozzles does not have to be in one plane.

Also, in the hot zone near the wall 24, some swirlers can be kept cool, while others are kept hot, as long as the entire flame is stable.

Liquid fuel can be prevaporized or directly injected into the nozzle 12. For the direct injection of liquid fuel, in the axial swirler design of FIG. 4, the liquid fuel can be injected from the inner body 42, outer body 40, vanes, or from a separate injection unit or injection units. In a tangential entry design shown in FIG. 6, the liquid fuel can be injected from the bottom of the swirl cup 58, the outer wall, the inlets 60, 62, or from a separate injection unit or injection units.

It is also preferred that the nozzles 12 in each of the arrays in the embodiments of FIGS. 1 and 2 have outlets 52 which terminate in a common plane 54, although this is not mandatory. It has been found that by providing such a non-staggered nozzle arrangement, the nozzles 12 in one array, due to the arrangement and the turbulent flow exiting the nozzle 12, can aid combustion of the fuel/air mixture in the nozzles 12 of an adjacent array or within the array. This is highly desirable from the standpoint of promoting flame stability. Such assistance is less effective in arrangements where the nozzle outlets are staggered although it is still possible.

Using the injectors 10 of the present invention, it is possible to achieve the production of low quantities of NOx, CO and UHC for extended power range and ambient conditions. For example, using the injector 10' of FIG. 2, it is possible to have NOx at a level of less than 7.0 ppm and to have both CO and UHC at levels less than 10 ppm for extended power or ambient range.

The injectors of the present invention don't turn fuel off to a particular array or ring. Fuel is always fed to each nozzle in each array or ring. Thus, in the injectors of the present invention, one does not have to worry about a disabled zone quenching an enabled zone. As a result, one does not have to have annular baffles and/or axial separation. In the injectors of the present invention, the various arrays or rings of nozzles 12 are designed to interact with each other.

Figure 7:
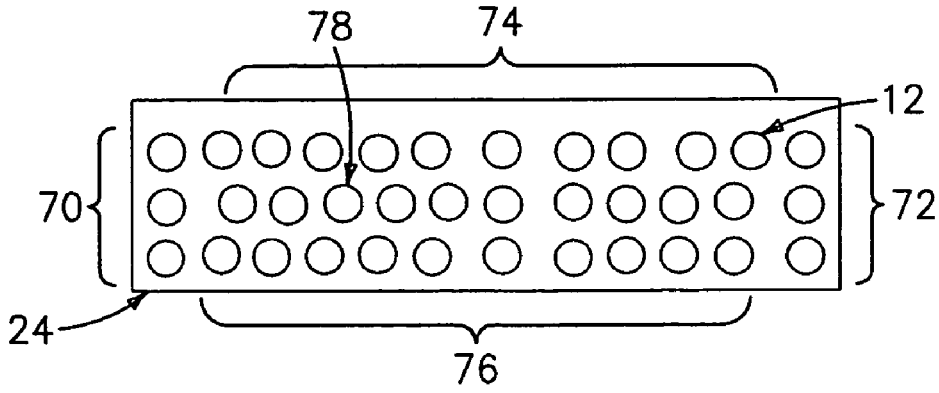
FIG. 7 illustrates a parallel array burner having five fuel zones.

FIG. 7 illustrates a parallel array burner having five fuel zones 70, 72, 74, 76, 78 with each fuel zone being independently controlled for staging the flame temperature in at least one zone, preferably the zone near the burner wall 24, is kept high enough to stabilize the entire flame.

It is apparent that there has been provided in accordance with the present invention a multi-point staging for low emissions and stable combustion which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A multi-point fuel injector for use in a combustor stage of a gas turbine engine comprising:

a plurality of nozzles arranged in a first outermost array;

a plurality of nozzles arranged in a second array, said second array being adjacent said first outermost array;

a first circuit for supplying fuel to said nozzles in said first outermost array, said first circuit having a first valve for controlling the supply of fuel to said nozzles;

a second circuit for supplying fuel to said nozzles in said second array, said second circuit having a second valve for controlling the supply of fuel to said nozzles in said second array, and said second circuit being independent of said first circuit;

each of said nozzles including a fluid channel formed by an outer body and an inner body spaced from said outer body; and means for creating a swirling flow within the fluid channel, said swirling flow creating means extending between said outer body and said inner body, wherein each nozzle in said first and second arrays has a swirling means which comprises a plurality of vanes within a central portion of said fluid channel, and wherein said central portion is spaced from an inlet and an outlet of said fluid channel.

2. The multi-point fuel injector according to claim 1, further comprising:

a plurality of nozzles arranged in a third array, said third array being located radially inward of said second array; and a third circuit for supplying fuel to said nozzles in said third array, said third circuit having a third valve for controlling the supply of fuel to said nozzles in said third array, and said third circuit being independent of said first and second circuits.

3. The multi-point fuel injector according to claim 2, further comprising:

a plurality of nozzles arranged in a fourth array, said fourth array being located radially inward of said third array; and a fourth circuit for supplying fuel to said nozzles in said fourth arrray, said fourth circuit having a fourth valve for controlling the supply of fuel to said nozzles in said fourth array, and said fourth circuit being independent of said first, second, and third circuits.

4. The multi-point fuel injector according to claim 1, wherein said vanes in said nozzles in said first array have a swirl angle different from said vanes in said nozzles in said second array.

5. The multi-point fuel injector according to claim 4, wherein said swirl angle for each said swirler vane in said first array is less than said swirl vane angle for each said swirler vane in said second array.

6. The multi-point fuel injector according to claim 1, wherein each of said nozzles has an outlet and said nozzle outlets in each of said arrays is arranged in a common plane to promote flame stability and interaction between the nozzles in said first and second arrays.

7. The multi-point fuel injector according to claim 1, wherein each of said arrays is an annular array.

8. The multi-point fuel injector according to claim 1, wherein each of said arrays has at least three nozzles.

* * * * *